US009238230B2

(12) United States Patent
Dunn

(10) Patent No.: US 9,238,230 B2
(45) **Date of Patent: *Jan. 19, 2016**

(54) VANE ELECTROSTATIC PRECIPITATOR

(71) Applicant: John P. Dunn, Horseheads, NY (US)

(72) Inventor: John P. Dunn, Horseheads, NY (US)

( * ) Notice: Subject to any disclaimer, the term of this patent is extended or adjusted under 35 U.S.C. 154(b) by 378 days.

This patent is subject to a terminal disclaimer.

(21) Appl. No.: 13/724,286

(22) Filed: Dec. 21, 2012

(65) Prior Publication Data

US 2013/0118349 A1 May 16, 2013

Related U.S. Application Data

(63) Continuation-in-part of application No. 13/369,823, filed on Feb. 9, 2012, now Pat. No. 8,894,745.

(60) Provisional application No. 61/521,897, filed on Aug. 10, 2011.

(51) Int. Cl.
*B03C 3/45* (2006.01)
*B03C 3/41* (2006.01)

(52) U.S. Cl.
CPC ... *B03C 3/45* (2013.01); *B03C 3/41* (2013.01); *B03C 2201/10* (2013.01)

(58) Field of Classification Search
USPC ..... 95/57, 59, 58, 61, 62, 63, 69, 70, 78, 95/79–81; 96/15, 17, 54, 55–58, 74, 96/75–79, 95–97, 98–100, 70, 60, 65, 64, 96/66, 67, 68, 69
See application file for complete search history.

(56) References Cited

U.S. PATENT DOCUMENTS

| | | | | |
|---|---|---|---|---|
| 1,956,591 | A | 5/1934 | Gies | |
| 2,357,734 | A | 9/1944 | Haber | |
| 2,700,429 | A | 1/1955 | Wintermute | |
| 2,712,858 | A | 7/1955 | Wintermute | |
| 2,969,127 | A | 1/1961 | Cook | |
| 3,271,932 | A * | 9/1966 | Newell | 96/67 |

(Continued)

FOREIGN PATENT DOCUMENTS

| | | |
|---|---|---|
| DE | 545606 C | 3/1932 |
| EP | 0237512 A1 | 9/1987 |
| EP | 1131162 B1 | 2/2006 |

OTHER PUBLICATIONS

Turner et al., "Sizing and Costing of Electrostatic precipitators, Part 1", Journal of Waste Manage Association, vol. 38, pp. 458-471, 1988.

*Primary Examiner* — Christopher P Jones
*Assistant Examiner* — Sonji Turner
(74) *Attorney, Agent, or Firm* — Brown & Michaels, PC

(57) ABSTRACT

The embodiments described herein improve on the present electrostatic precipitator method of using parallel plates to collect particulates by using multiple parallel vanes set at operating parameters described below. By using vanes, the main entrained air is subdivided and directed to flow between vanes that induce resistance to flow allowing charged particles to collect on the vanes. The width of the vane is designed to be wide enough so the air flow rate at the ends of the vanes is less than 1 ft/s, allowing particles discharged from the plates to fall by gravity and in the direction of very low air flow, resulting in extremely low re-entrainment and efficient particle collection. Using vanes also allows for higher operating air velocities resulting in a smaller equipment foot print.

21 Claims, 4 Drawing Sheets

(56) References Cited

U.S. PATENT DOCUMENTS

| | | | | | |
|---|---|---|---|---|---|
| 3,338,035 | A | | 8/1967 | Dinkelacker | |
| 3,355,864 | A | | 12/1967 | Sobeck | |
| 3,478,494 | A | | 11/1969 | Lustenader et al. | |
| 3,678,653 | A | * | 7/1972 | Buschman | 96/66 |
| 3,693,328 | A | | 9/1972 | Paucha | |
| 3,733,785 | A | | 5/1973 | Gallaer | |
| 3,757,498 | A | | 9/1973 | Hurlbut, Sr. et al. | |
| 3,807,140 | A | | 4/1974 | Gurvits et al. | |
| 3,958,962 | A | | 5/1976 | Hayashi | |
| 4,007,023 | A | | 2/1977 | Batza | |
| 4,093,432 | A | | 6/1978 | Ahlrich | |
| 4,172,028 | A | | 10/1979 | Dunn | |
| 4,178,156 | A | * | 12/1979 | Tashiro et al. | 95/59 |
| 4,181,509 | A | | 1/1980 | Honacker et al. | |
| 4,231,766 | A | | 11/1980 | Spurgin | |
| 4,246,010 | A | | 1/1981 | Honacker | |
| 4,264,343 | A | | 4/1981 | Natarajan et al. | |
| 4,265,641 | A | | 5/1981 | Natarajan | |
| 4,412,850 | A | | 11/1983 | Kurata et al. | |
| 4,478,614 | A | | 10/1984 | Jonelis | |
| 4,481,017 | A | | 11/1984 | Furlong | |
| 4,666,475 | A | | 5/1987 | Gustavsson | |
| 4,713,092 | A | * | 12/1987 | Kikuchi et al. | 96/70 |
| 4,725,289 | A | * | 2/1988 | Quintilian | 95/76 |
| 4,832,710 | A | | 5/1989 | Jury | |
| 5,156,658 | A | | 10/1992 | Riehl | |
| 5,215,558 | A | | 6/1993 | Moon | |
| 5,466,279 | A | | 11/1995 | Hattori et al. | |
| 5,547,493 | A | | 8/1996 | Krigmont | |
| 5,601,791 | A | | 2/1997 | Plaks et al. | |
| 5,993,521 | A | | 11/1999 | Loreth et al. | |
| 6,004,376 | A | * | 12/1999 | Frank | 95/79 |
| 6,152,988 | A | | 11/2000 | Plaks et al. | |
| 6,482,253 | B1 | | 11/2002 | Dunn | |
| 6,524,369 | B1 | | 2/2003 | Krigmont | |
| 6,773,489 | B2 | * | 8/2004 | Dunn | 95/78 |
| 6,962,620 | B2 | * | 11/2005 | Chang et al. | 96/60 |
| 7,022,166 | B2 | | 4/2006 | Gittler | |
| 7,105,041 | B2 | * | 9/2006 | Dunn | 96/66 |
| 7,582,144 | B2 | | 9/2009 | Krigmont | |
| 7,582,145 | B2 | | 9/2009 | Krigmont | |
| 7,585,352 | B2 | | 9/2009 | Dunn | |
| 7,901,489 | B2 | * | 3/2011 | Jin et al. | 96/30 |
| 2001/0039877 | A1 | | 11/2001 | Hein | |
| 2009/0071328 | A1 | | 3/2009 | Dunn | |
| 2010/0037766 | A1 | * | 2/2010 | Boyden et al. | 95/2 |
| 2010/0037767 | A1 | * | 2/2010 | Boyden et al. | 95/5 |
| 2011/0139009 | A1 | | 6/2011 | Nakahara et al. | |

* cited by examiner

VANE ELECTROSTATIC PRECIPITATOR

REFERENCE TO RELATED APPLICATIONS

This is a continuation-in-part patent application of copending application Ser. No. 13/369,823, filed Feb. 9, 2012, entitled "VANE ELECTROSTATIC PRECIPITATOR", which claims one or more inventions which were disclosed in Provisional Application No. 61/521,897, filed Aug. 10, 2011, entitled "VANE ELECTROSTATIC PRECIPITATOR (VEP)". The benefit under 35 USC §119(e) of the United States provisional application is hereby claimed, and the aforementioned applications are hereby incorporated herein by reference.

BACKGROUND OF THE INVENTION

1. Field of the Invention

The invention pertains to the field of electrostatic precipitators. More particularly, the invention pertains to vane electrostatic precipitators.

2. Description of Related Art

U.S. Pat. No. 4,172,028 discloses an electrostatic sieve having parallel sieve electrodes that are either vertical or inclined. The particles are normally introduced into the electric sieve under the control of a feeder that is placed directly in front of the opposing screen electrode. The powder is attracted directly from the feeder tray to the opposing screen electrode by an induced electric field that exists between the tray and the screen electrode. This system is a static air system.

U.S. Pat. No. 4,725,289 uses flow dividers in an electrostatic precipitator to try to control flow. Discharge of collected dust particles is still taking place where the air flow is relatively high, making re-entrainment a strong possibility.

Prior art precipitators have difficulty collecting highly conductive and very poorly conductive particulates.

There is also a need to improve on present electrostatic precipitator technology used to continuously collect coarse and fine coal ash particles from coal fired boilers related to the fact that bag houses are now used in conjunction with electrostatic precipitators to better clean the air.

SUMMARY OF THE INVENTION

The embodiments described herein improve on the present electrostatic precipitator method of using parallel plates to collect particulates by using multiple parallel vanes set at the operating parameters described below. By using vanes, the main entrained air is subdivided and directed to flow between vanes that induce resistance to flow, allowing charged particles to collect on the vanes. The vane is designed to be wide enough so the air flow rate at the ends of the vanes is less than one foot per second (<1 ft/s), allowing particles discharged from the plates to fall by gravity and in the direction of very low air flow, resulting in extremely low re-entrainment and efficient particle collection. Using vanes also allows for higher operating air velocities resulting in a smaller equipment foot print.

In one embodiment, a method for removing particles from at least one main narrow air stream uses a vane electrostatic precipitator including opposing vane type collecting electrodes. A leading edge of each vane type collecting electrode is offset from an adjacent leading edge such that each vane type collecting electrode is either longer or shorter than a preceding vane type collecting electrode to improve control and efficiency of collection of the particles. The method includes dividing the main narrow air stream into at least two smaller individual air streams in the vane electrostatic precipitator. The smaller individual air streams refer to the air that flows between the vanes. The method also preferably includes a step of dimensioning an input orifice and/or an output orifice and the vane type collecting electrodes to match operational requirements of the main narrow air stream.

The vane electrostatic precipitator in some preferred embodiments may further include saw tooth discharge electrodes located on an angle matching an angle of the leading edges of the vane type collecting electrodes. The vane type collecting electrodes are preferably located at ground potential resulting in no electrical field being established between opposing vane type collecting electrode surfaces and an electrical field is established between the leading edge of the vane type collecting electrodes and the discharge electrodes.

The method may preferably also include a step of dividing the vane type collecting electrodes into a plurality of operating groups each including at least two vane electrodes.

The operating groups are preferably combined into a vane assembly to match operating requirements for the vane electrostatic precipitator.

In another embodiment, a vane electrostatic precipitator includes vane electrodes having a leading edge and located at ground potential and discharge electrodes located at an angle matching the main air flow direction and in proximity to a leading edge of the vane electrodes, such that an electrical field is established between the leading edge of the vanes and the discharge electrodes and no electrical field exists between opposing surfaces of the vanes. A method collects particulates using this vane electrostatic precipitator using an electrical field established between the leading edge of the vane electrodes and the saw tooth discharge electrodes. The method also preferably includes a step of dimensioning an input orifice and/or an output orifice and the vane type collecting electrodes to match operational requirements of an air stream.

In another embodiment, the main air stream is divided into a number of smaller individual streams in a vane electrostatic precipitator. The vane electrostatic precipitator includes opposing vane type collecting electrodes that are tapered as an assembly from front to back and towards the center of the main air flow of the collection chamber to improve control and efficiency of collection of the particles.

In another embodiment, a vane electrostatic precipitator includes vane electrodes having a leading edge and a plurality of discharge electrodes facing the leading edge of the vane electrodes. The vane electrodes are located at ground potential resulting in no electrical field being established between opposing vane surfaces. An electrical field is established between the leading edge of the vane electrodes and the discharge electrodes.

DETAILED DESCRIPTION OF THE INVENTION

The terms "vane", "vane electrode", and "vane type collecting electrode" are used interchangeably herein.

Several new factors have been identified as having a major bearing on the collection efficiency of a vane electrostatic precipitator. These include the vane offset, the width of the orifices (with wider orifices, the air flow capacity increases and, in some applications, the length of the field is reduced), the vane assembly angle and the position of discharge electrodes in relation to the leading edges of the vane electrodes.

Figure 1:
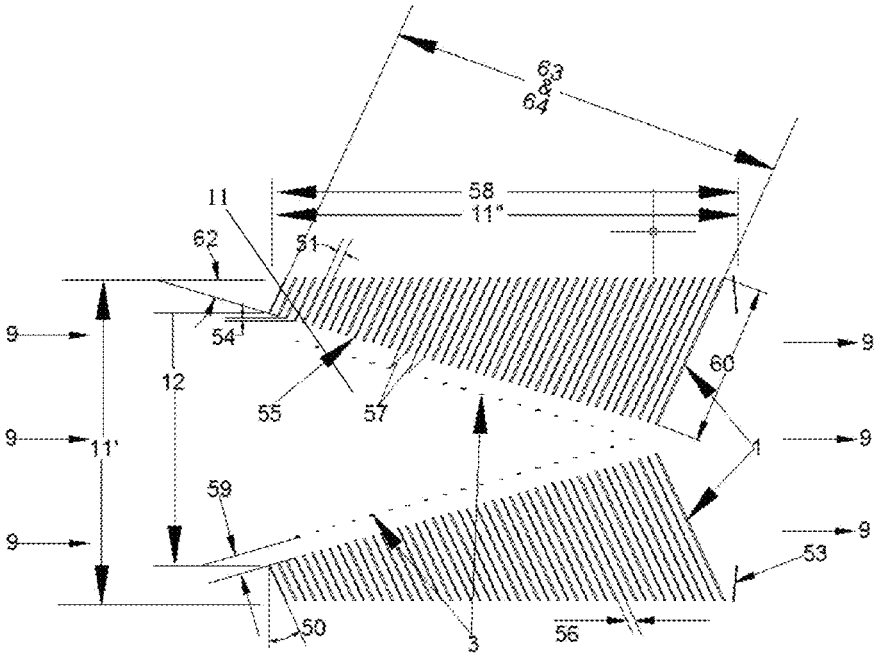
FIG. 1 shows a cross sectional view of one embodiment of a vane assembly found in a single chamber with various components that affect efficient collection.

FIG. 1 shows a vane electrostatic precipitator in an embodiment of the present invention. Air flow (9) enters through an input orifice (12). FIG. 1 shows some of the main factors that affect how the vane electrostatic precipitator functions. These include the vane operating angle (50), the distance (51) between vanes (1), the total vane surface area (53) (which includes the surface area on both sides of each vane) per collection chamber (11), the amount of offset (54) of the vanes (1), the vane width (60), the vane assembly angle (62), the number (57) of vanes (1) per collection chamber (11), and the number of vanes (1) per the number of discharge electrodes (3).

The number of vanes per field and the vane area per field are related to the selection of the type of vane (1) design and to the desired efficiency of a vane electrostatic precipitator.

Note that the collection chamber (11) includes the width (11'), length (11"), and height (not shown) dimensions. The vane width (60) in a vane group (63) (two or more vanes that are grouped together to operate with the same operating parameters) may be constant or may vary along the length of the field (58), as shown in FIG. 1.

In developing the vane electrostatic precipitator, several new factors were discovered that have a major bearing on the collection efficiency of the vane electrostatic precipitator. These include the vane offset (54), the distance (59) the discharge electrodes (3) are from the leading edge (55) of the vane electrodes (1) and the vane assembly angle (62).

Figure 2:
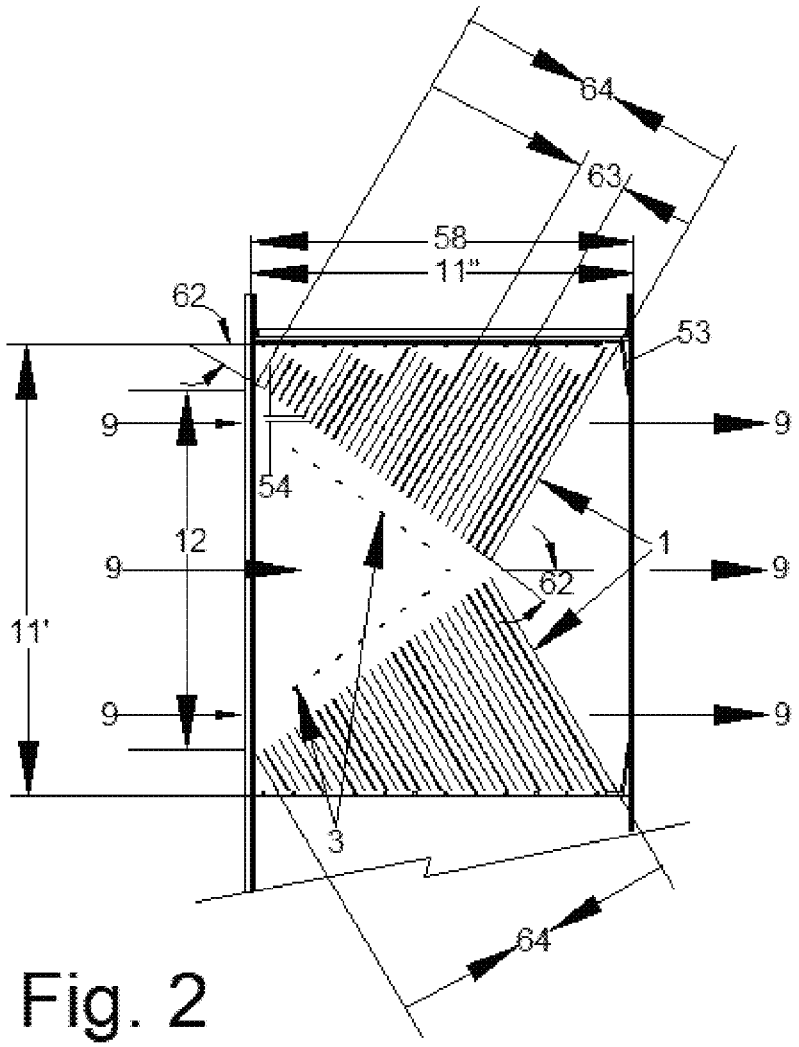
FIG. 2 shows a cross sectional view showing the saw tooth discharge electrodes aligned to be in the direction of the main air flow and to follow the leading angle of the vane electrodes.

The vane offset (54) refers to how much longer the next vane (1) is in relation to the preceding one. This offset (54), in combination with the distance (51) between a vane pair (two vanes) (56) determines the percent of the main air flow (9) that is expected to flow between each vane pair (56). The greater the offset (54), the larger the percentage of air diverted from the main air stream (9). This results in a number of other changes, including that the air flow rate increases with less flow interference, resulting in the possibility that vanes with a larger surface area are required but at the same time a lower number of vanes are used per chamber, as shown in FIG. 2. FIG. 2 has approximately 1½ times greater vane offset (54) than FIG. 1.

The type of discharge electrodes (3) (for example saw tooth discharge electrodes as shown in all four figures), the number of discharge electrodes (3), the position of the discharge electrodes (3), either parallel to the main air flow (9) or parallel to the vane operating angle (50), and the number of vanes (1) required per discharge electrode (3) are based on factors related to the type of material being processed and the power restrictions. In preferred embodiments, the discharge electrodes (3) are parallel to the main air flow (9) (as shown in FIG. 1). This reduces the power needs of the vane electrostatic precipitator, as well as making the charging process more efficient. In some embodiments, distances of approximately 1 to 2 inches between the leading edge (55) of the vane (1) and the discharge electrodes (3) are preferred.

If circular wire discharge electrodes (3) are used, the directional placement in relation to the vanes (1) is not an issue, just the location. For this particular application. the saw tooth discharge electrode (3) is the preferred choice because of its uniformity of discharge along its length and, depending on its size, can affect the air flow.

The selection of the vane operating angle (50) and the vane width (60) are dependent on a number of factors, but one of the major factors is related to the amount of drag or interference to the flow that is required to meet the desired collection vane exit flow rate of less than <1 ft/s. Sharper angles (50) and wider (60) vanes (1) increase the interference to flow.

The distance (51) between the vanes (1) can have two effects on the process. It can determine whether both sides of the vanes (1) collect particulates and the amount of turbulence or drag induced on the entrained air. Collecting on both sides of the vanes is a desirable feature because it also reduces the overall length of the vane electrostatic precipitator. For applications where the particle concentration per cubic centimeter is high, the distance (51) between the vanes may have to be increased.

The required vane surface area (53) per collection chamber (11) and the number of fields (58) are related to the actual cubic feet per minute (ACFM) of air flow and the desired efficiency of the vane electrostatic precipitator.

Figure 3:
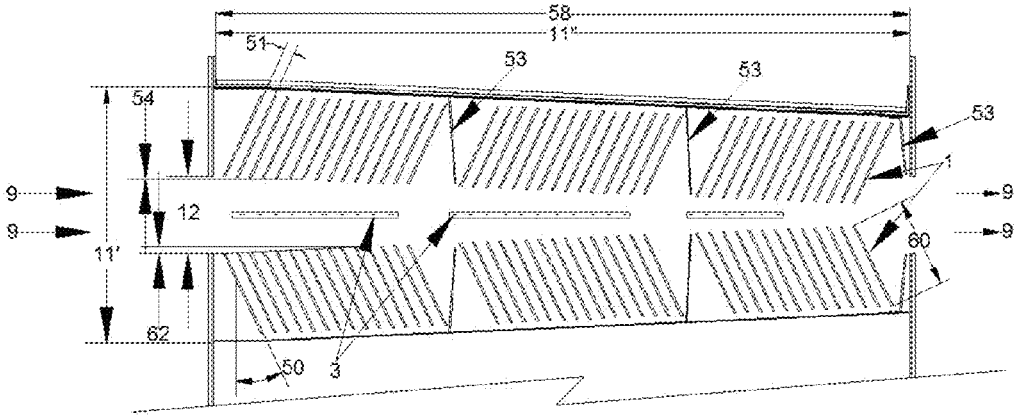
FIG. 3 is a cross sectional view of a vane electrostatic precipitator where the vane assembly angle is small in order to achieve high cubic flow per minute (CFM) using high air flow rates.

FIG. 3 is cross sectional view of a vane electrostatic precipitator where the air flow rates are very high (>20 ft/m) in order to achieve a high volume of air flow (CFM). FIG. 3 shows the vane assembly tapered from front to back and towards a center of the main air flow of the collection chamber, which improves control and efficiency of collection of the particles.

FIG. 3 shows a vane assembly angle (62) of approximately 1 to 3 degrees, while in FIGS. 1 and 2, the vane assembly angles (62) are preferably at 16 and 30 degrees, respectively. For efficient operation, the ratio of field length (58) to the aperture/input orifice opening (12) is high and the vane offset (54) is very small because of the higher volume of air flow each vane is expected to handle. The discharge electrodes in FIG. 3 are centrally located and are assembled into groups that operate at different power levels.

FIG. 3 shows an example of an operating unit where the field length (58) is 40 inches, the input orifice (12) is 4.37 inches, and the vane offset is 0.025". The ratio of field length (58) to the aperture/input orifice opening (12) is approximately 9:1. The small vane offset and the high ratio of the field length (58) to the aperture/input orifice opening (12) has resulted in efficient collection of particles. These dimensions are examples only, and the preferred dimensions for each application will depend on process requirements.

Figure 4:
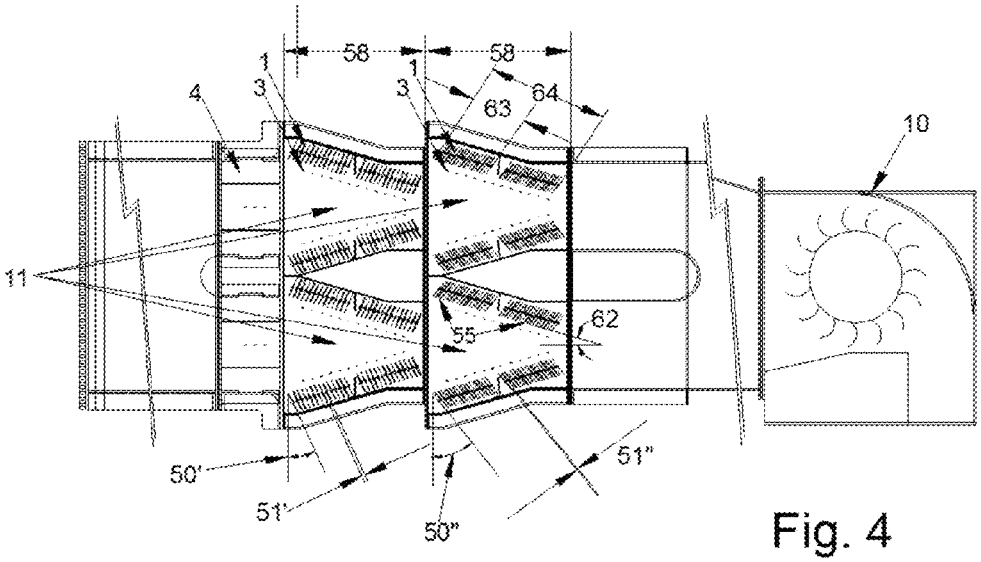
FIG. 4 shows a cross sectional view of a vane electrostatic precipitator that has two fields and four collection chambers.

FIG. 4 shows a cross sectional view of a vane electrostatic precipitator assembly that has a pre-charger (4), a two-field (58), four-chamber (11) vane electrostatic precipitator that has vanes (1) preferably set at 25 degree (50') and 42 degree (50") angles with two different spacing's (51') (51") between the vanes (1). A blower (10) is also shown. FIGS. 1, 2 and 4 also show the discharge electrodes (3) in a V-shape arrangement. This arrangement is more effective in charging the particulates when the vane assembly angle (62) becomes large, resulting in less power being required because of the closer proximity of the vanes (1) to the discharge electrodes (3).

FIG. 4 shows how the vane assembly angle (62) is equal to the angle the leading edge (55) of the vanes (1) makes with the center line of the main air flow (9). The selection of the vane assembly angle (62) is based on the foot print restrictions, air flow rates and capacity requirements. FIG. 4 also shows how the vane assembly (64) can be divided into groups (63) for making the collection process and the fabrication both more efficient.

Figure 5:
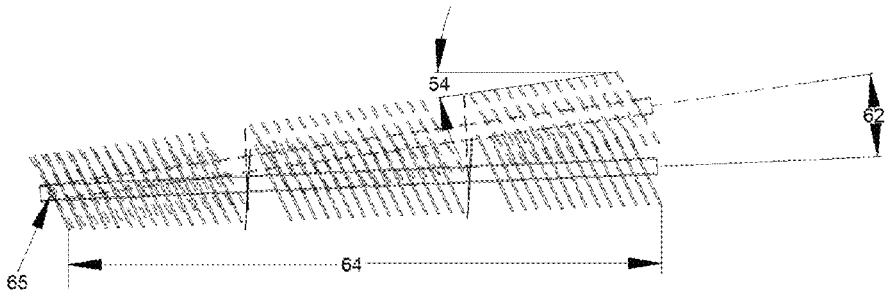
FIG. 5 shows a cross sectional view of a vane electrostatic precipitator where the vane assembly angle is changeable during operation.
Figure 6:
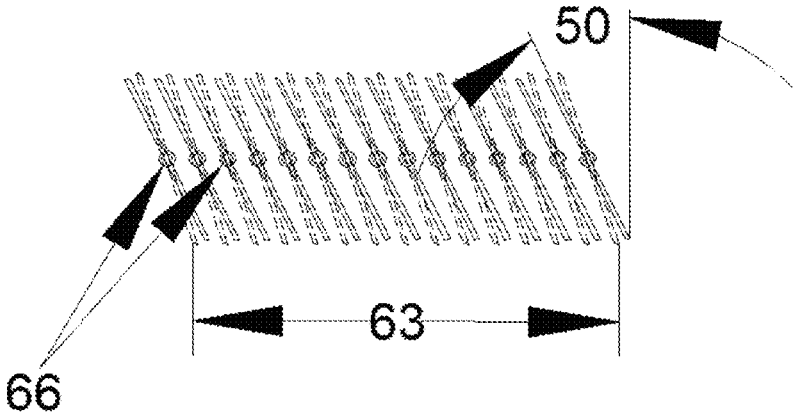
FIG. 6 shows a cross sectional view of a vane electrostatic precipitator where the vane operating angle is changeable during operation.

Other desirable operating features that will in some cases improve on the collection of particulates are the ability to change the vane assembly angle (62) and/or the vane operating angle (50) during operation. FIG. 5 shows the vane assembly (64) rotated at the pivot point (65) to a desired position. FIG. 6 shows a vane group (63) and the pivot points (66) for adjusting the vane operating angle (50). An advantage of these capabilities is related to the ability to adjust for major changes in operating temperature or mass flow (particle concentration), especially during the start up of the process.

Listed below are a number of design parameters and operating variables that need to be considered and can be addressed by using computer modeling or by pilot model operating data, where some of the variables could be varied during the process to obtain the most efficient collection. Parameters a) through g) are specific parameters that are varied in embodiments discussed herein to improve collection and efficiency of the vane electrostatic precipitator.

DESIGN PARAMETERS AND OPERATING VARIABLES TO CONSIDER FOR THE VANE ELECTROSTATIC PRECIPITATOR a) Operating angle of discharge electrode versus vane assembly angle
b) Vane operating angle
c) Distance between vanes
d) Offset distance between vanes
e) Vane assembly operating angle (taper)
f) Vane assembly operating angle versus aperture dimension
g) Number of vane groups in a vane assembly
h) Type of dust to be collected
i) Dust concentration
j) Operating temperature (° C.)
k) ACFM required
l) Input air flow rate: (ACFS)
m) Plate collection area per ACFS
n) Vane collecting area per ACFS
o) Operating pressure (in w)
p) Migration velocity of particle to plate
q) Migration velocity of particle to vane
r) Aperture dimensions
s) Field, number and dimensions
t) Number of collecting chambers
u) Collection chamber dimensions
v) Angle and number of discharge electrodes per vane
w) Spacing between discharge electrodes
x) Type and size of discharge electrode
y) Power: (KW/ACFM) per collecting chamber
z) Operating voltage (DC) per discharge bus bar
aa) Number of discharge electrodes per collection chambers
bb) Operating current per discharge bus par
cc) Power per discharger bus bar
dd) Type of vane, straight or contour and material
ee) Dimensions of vane (thickness, width, Height, arc) (note: each vane may have a different width)
ff) Number of vanes per collection chamber
gg) Surface area per vane
hh) Number of vanes in a vane group
ii) Baffles, type, porous or solid Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method for removing particles from at least one main narrow air stream, comprising the step of dividing the main air stream into at least two smaller individual air streams in a vane electrostatic precipitator comprising a plurality of opposing vane type collecting electrodes, wherein a leading edge of each vane type collecting electrode is offset from an adjacent leading edge such that each vane type collecting electrode is either longer or shorter than a preceding vane type collecting electrode.

2. The method of claim 1, further comprising the step of dimensioning an input orifice and/or an output orifice and the vane type collecting electrodes to match operational requirements of the main narrow air stream.

3. The method of claim 1, wherein the vane electrostatic precipitator further comprises a plurality of saw tooth discharge electrodes located on an angle matching an angle of the leading edges of the vane type collecting electrodes; further comprising the steps of locating the plurality of vane type collecting electrodes at ground potential resulting in no electrical field being established between opposing vane surfaces; and establishing an electrical field between the leading edge of the vane type collecting electrodes and the discharge electrodes.

4. The method of claim 3, wherein a distance between the leading edge of the vane type collecting electrodes and the saw tooth discharge electrodes is between approximately 1 to 2 inches.

5. The method of claim 1, wherein the vane type collecting electrodes in the vane electrostatic precipitator are divided into a plurality of operating groups each comprising at least two vane type collecting electrodes, further comprising the step of combining the operating groups into a vane assembly to match operating requirements for the vane electrostatic precipitator.

6. The method of claim 1, wherein a ratio of field length to an input orifice of the vane electrostatic precipitator is at least approximately 9:1.

7. The method of claim 1, wherein an offset between adjacent vane type collecting electrodes is less than or equal to approximately 0.025 inches.

8. The method of claim 1, further comprising the step of adjusting a vane assembly angle during operation.

9. The method of claim 1, further comprising the step of adjusting a vane operating angle during operation.

10. A method of collecting a plurality of particulates using a vane electrostatic precipitator, comprising the step of collecting the particulates using an electrical field established between a leading edge of a plurality of vane electrodes and a plurality of saw tooth discharge electrodes spaced a distance of approximately 1 to 2 inches from the leading edge of the vane electrodes;

wherein the vane electrostatic precipitator comprises the plurality of vane electrodes located at ground potential and the plurality of discharge electrodes located parallel to a main air flow direction and in proximity to the leading edge of the vane electrodes, such that the electrical field is established between the leading edge of the vane electrodes and the discharge electrodes and no electrical field exists between opposing surfaces of the vane electrodes.

11. The method of claim 10, further comprising the step of dimensioning at least one of an input orifice or an output orifice of the vane electrostatic precipitator and the vane electrodes to match operational requirements of an air stream.

12. The method of claim 10, wherein a ratio of field length to an input orifice of the vane electrostatic precipitator is at least approximately 9:1.

13. The method of claim 10, wherein an offset between adjacent vane electrodes is less than or equal to approximately 0.025 inches.

14. A method for removing particles from a main narrow air stream, comprising the step of dividing the main narrow air stream into at least two smaller individual narrow air streams in a vane electrostatic precipitator comprising a plurality of opposing vane type collecting electrodes that are tapered as an assembly from a front to a back of the vane electrostatic precipitator and towards a center of a main air flow of a collection chamber.

15. A vane electrostatic precipitator comprising a plurality of rotatable vane electrodes, each rotatable vane electrode comprising a leading edge, and a plurality of discharge electrodes, wherein ends of the discharge electrodes face the leading edge of the rotatable vane electrodes, wherein the plurality of rotatable vane electrodes are located at ground potential resulting in no electrical field being established between opposing rotatable vane electrode surfaces; and wherein an electrical field is established between the leading edge of the rotatable vane electrodes and the discharge electrodes.

16. The vane electrostatic precipitator of claim 15, wherein the discharge electrodes comprise a plurality of saw tooth discharge electrodes, wherein the teeth of the saw tooth discharge electrodes face the leading edge of the rotatable vane electrodes.

17. The vane electrostatic precipitator of claim 15, further comprising an input orifice where a main air stream enters the vane electrostatic precipitator and an output orifice, where the main air stream exits the vane electrostatic precipitator, wherein at least one of the input orifice or the output orifice is dimensioned to match operational requirements of an air stream.

18. The vane electrostatic precipitator of claim 15, wherein a distance between the leading edge of the rotatable vane electrodes and the discharge electrodes is between approximately 1 to 2 inches.

19. The vane electrostatic precipitator of claim 15, further comprising an input aperture where a main air stream enters the precipitator wherein a ratio of field length to an input aperture of the vane electrostatic precipitator is at least approximately 9:1.

20. The vane electrostatic precipitator of claim 15, wherein the leading edge of each rotatable vane electrode is offset from an adjacent leading edge such that each vane electrode is either longer or shorter than a preceding vane electrode.

21. The vane electrostatic precipitator of claim 20, wherein the offset between adjacent rotatable vane electrodes is less than or equal to approximately 0.025 inches.

* * * * *